US005877785A

United States Patent [19]

Iwasaki et al.

[11] Patent Number: 5,877,785

[45] Date of Patent: Mar. 2, 1999

[54] INK JET RECORDING METHOD AND APPARATUS USING TEMPERATURE CALCULATION

[75] Inventors: Osamu Iwasaki, Kawasaki; Naoji Otsuka, Yokohama; Nobuyuki Kuwabara, Kawasaki; Isao Ebisawa, Yokohama; Atsushi Arai; Hisao Yaegashi, both of Kawasaki; Toshiharu Inui; Kentaro Yano, both of Yokohama; Kiichiro Takahashi, Kawasaki; Daigoro Kanematsu, Yokohama, all of Japan

[73] Assignee: Canon Kabushiki Kaisha, Tokyo, Japan

[21] Appl. No.: 333,342

[22] Filed: Nov. 2, 1994

[30] Foreign Application Priority Data

Nov. 2, 1993 [JP] Japan ..... 5-274414

[51] Int. Cl.[6] ..... B41J 29/38

[52] U.S. Cl. ..... 347/14; 347/17; 347/194; 364/557

[58] Field of Search ..... 347/14, 19, 195, 347/196, 17, 194; 364/555, 557

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,093,673 | 3/1992 | Sakai et al. | 347/211 |
| 5,166,699 | 11/1992 | Yano et al. | 347/17 |
| 5,175,565 | 12/1992 | Ishinaga et al. | 347/67 |
| 5,268,706 | 12/1993 | Sakamoto | 347/180 |
| 5,367,325 | 11/1994 | Yano et al. | 347/17 |
| 5,485,179 | 1/1996 | Otsuka et al. | 347/14 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—Benjamin R. Fuller
*Assistant Examiner*—Craig A. Hallacher
*Attorney, Agent, or Firm*—Fitzpatrick, Cella, Harper & Scinto

[57] ABSTRACT

An ink jet apparatus using an ink jet head having a heat generating element for generating thermal energy to be used to discharge ink, comprises a unit for deriving an amount $\Delta Q_i$ indicative of a heat amount stored in i ($i \geqq 1$) portions of said ink jet head sectioned by thermal time constants, corresponding to a heat amount applied to said ink jet head at a predetermined time interval $\Delta t$, a unit for multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant, a unit for adding the amount $\Delta Q_i$ to the product, a unit for storing the sum as the amount $\Delta T_i(n)$ indicative of the heat amount stored in the i-sectioned portion, a unit for summing all amounts $\Delta T_1(n)$ to determine an amount $\Delta T$ corresponding to the heat amount stored in said ink jet head and a unit for controlling said ink jet head in accordance with the amount $\Delta T$.

34 Claims, 11 Drawing Sheets

INK JET RECORDING METHOD AND APPARATUS USING TEMPERATURE CALCULATION

BACKGROUND OF THE INVENTION

1. Field of the Invention

The present invention relates to an ink jet apparatus based on a temperature calculation and an ink jet head control method, and more particularly to an ink jet apparatus which uses an ink jet head of a type which utilizes thermal energy for discharging liquid and a control method of the ink jet head.

2. Related Background Art

An ink jet system which permits application of a small amount of liquid to a medium has been widely used in various fields such as printing, image recording and drying, and it is so rich in the application that the applications to other fields have been expected.

For example, as a personal computer, a word processor and a facsimile machine have become popular in offices and homes, printers of various recording systems have been developed as output devices for those equipments. Among others, the ink jet recording system is most appropriate for personal use in the office because of its low record noise and a high quality of record for various kinds of recording media as well as its compactness. Of the ink jet recording system, a bubble jet system which is a thermal system of high drive response has been one of main streams. In this system, an electrical signal is converted to a heat by a recording head to film-boil ink, which is in turn discharged to a recording medium by utilizing a pressure by boiling.

Ink droplets deposited to the recording medium spread on the recording medium to form dots. An image is formed and recorded by an aggregation of dots. An area of one dot largely depends on a size of ink droplet or an amount of discharged ink. Thus, in order to attain high quality recording in the ink jet recording system, it is most important to control the amount of discharge. When a drive pulse applied to a heat generating element is constant, the amount of discharge depends on a temperature of the ink in the vicinity of the heat generating element. Thus, it is necessary to control the ink temperature, but since it is practically difficult to control it, it is common to control a temperature of a chip which forms the recording head instead of controlling the ink temperature. Usually, a temperature sensor is provided in the recording head chip but it has been proposed to use a method for estimating the temperature of the recording head from a record pattern instead of or together with the provision of the temperature sensor while taking the increase in a cost of an amplifier and noise countermeasures as well as reliability of the temperature sensor into consideration.

However, as the drive frequency has increased and the number of discharge ports (or ejection outlets) per chip has increased by the recent speedup of the recording speed, a change of the recording chip temperature for time has increased and it has been strongly demanded to use more precise method than the prior art temperature estimation method. The high preciseness may be attained by shortening the time of temperature estimation calculation but in this method, a burden of the recording apparatus to the calculation increase as the time is shortened and a throughput is reduced, or it is required to enhance the performance of an MPU which is calculation means.

SUMMARY OF THE INVENTION

It is an object of the present invention to provide a temperature estimation method which is precise and of low load of calculation.

It is another object of the present invention to provide an ink jet apparatus which uses a temperature estimation method which is precise and of low load of calculation, and a control method for an ink jet head.

In order to achieve the above objects, the present invention provides an ink jet apparatus using an ink jet head having a heat generating element for generating thermal energy to be used to discharge ink, comprising: means for deriving an amount $\Delta Q_i$ indicative of a heat amount stored in i($\geqq 1$) portions of said ink jet head sectioned by thermal time constants, corresponding to a heat amount applied to said ink jet head at a predetermined time interval $\Delta t$; means for multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant; means for adding the amount $\Delta Q_i$ to the product; means for storing the sum as the amount $\Delta T_i(n)$ indicative of the heat amount stored in the i-sectioned portion; means for summing all amounts $\Delta T_i(n)$ to determine an amount $\Delta T$ corresponding to the heat amount stored in said ink jet head; and means for controlling said ink jet head in accordance with the amount $\Delta T$.

The present invention further provides an ink jet apparatus using an ink jet head having a heat generating element for generating thermal energy to be used to discharge ink, comprising; means for driving discharge heaters arranged in the ink jet head into groups in accordance with the arrangement position of the discharge heaters and deriving an amount $\Delta Q_i$ indicative of a heat amount stored in i ($i \geqq 1$) portions of said ink jet head sectioned by thermal time constants, corresponding to a heat amount applied to said ink jet head at a predetermined time interval $\Delta t$, independently for each group; means for multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant; means for multiplying a difference between the stored heat amounts $\Delta T_i(n-1)$ between adjacent groups of said ink jet head to calculate a correction amount $\Delta q_i$; means for summing the amount $\Delta Q_i$, the product and the correction amount to calculate a sum for each group; means for storing the sum as the amount $\Delta T_i(n)$ indicative of the heat amount stored in the i-sectioned portion for each group of said ink jet head; means for summing all amounts $\Delta T_i(n)$ to determine an amount $\Delta T$ corresponding to the heat amount stored in each group of said ink jet head; and means for controlling the groups of said ink jet head in accordance with the amount $\Delta T$.

The present invention further provides a control method for an ink jet head having a heat generating element for generating thermal energy to be used to discharge ink, comprising: a step of deriving an amount $\Delta Q_i$ indicative of a heat amount stored in i ($i \geqq 1$) portions of said ink jet head sectioned by thermal time constants, corresponding to a heat amount applied to said ink jet head at a predetermined time interval $\Delta t$; a step of multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant, a step of adding the amount $\Delta Q_i$ to the product; a step of storing the sum as the amount $\Delta T_i(n)$ indicative of the heat amount stored in the i-sectioned portion; a step of summing all amounts $\Delta T_i(n)$ to determine an amount $\Delta T$ corresponding to the heat amount stored in said ink jet head; and a step of controlling said ink jet head in accordance with the amount $\Delta T$.

The present invention further provides an ink jet method in an ink jet apparatus using an ink jet head having a heat generating element for generating thermal energy to be used to discharge ink, comprising a step of dividing discharge heaters arranged in the ink jet head into groups in accordance with the arrangement position of the discharge heaters and deriving an amount $\Delta Q_i$ indicative of a heat amount stored in i ($i \geqq 1$) portions of said ink jet head sectioned by thermal time constants, corresponding to a heat amount applied to said ink jet head at a predetermined time interval $\Delta t$, independently for each group; a step of multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant; a step of multiplying a difference between the stored heat amounts $\Delta T_i(n-1)$ between adjacent groups of said ink jet head to calculate a correction amount $\Delta q_i$; a step of summing the amount $\Delta Q_i$, the product and the correction amount to calculate a sum for each group; a step of storing the sum as the amount $\Delta T_i(n)$ indicative of the heat amount stored in the i-sectioned portion for each group of said ink jet head; a step of summing all amounts $\Delta T_i(n)$ to determine an amount $\Delta T$ corresponding to the heat amount stored in each group of said ink jet head; and a step of controlling the groups of said ink jet head in accordance with the amount $\Delta T$.

The present invention further provides a temperature calculation apparatus for detecting a temperature of an object varying with an energy applied thereto, comprising: means for deriving an mount $\Delta Q_i$ indicative of a heat amount stored in $i(i \geqq 1)$ portions of said object sectioned by thermal time constants, corresponding to a heat amount applied to said object at a predetermined time interval $\Delta t$; means for multiplying an amount $\Delta T$ (n−1) indicative of the heat amount stored in the i-sectioned portion of the predetermined time interval $\Delta t$ earlier by a predetermined constant $E_i$ corresponding to the sectioned thermal time constant; means for adding the amount $\Delta Q_i$ to the product; means for storing the sum as the amount $\Delta T_i(n)$ indicative of the heat amount stored in the i-sectioned portion; and means for summing all amounts $\Delta T_i(n)$ to determine an amount $\Delta T$ corresponding to the heat amount stored in said object.

The present invention further provides a temperature calculation method for detecting a temperature of an object varying with an energy applied thereto, comprising: a step of deriving an amount $\Delta Q_i$ indicative of a heat amount stored in $i(i-\geqq 1)$ portions of said object sectioned by thermal time constants, corresponding to a heat amount applied to said object at a predetermined time interval $\Delta t$; a step of multiplying an amount $\Delta T_i(n-1)$ indicative of the heat amount stored in the i-sectioned portion of the predetermined time interval $\Delta t$ earlier by a predetermined constant $E_i$ corresponding to the sectioned thermal time constant; a step of adding the amount $\Delta Q_i$ to the product; a step of storing the sum as the amount $\Delta T_i(n)$ indicative of the heat amount stored in the i-sectioned portion; and a step of for summing all amounts $\Delta T_i(n)$ to determine an amount $\Delta T$ corresponding to the heat amount stored in said object.

DETAILED DESCRIPTION OF THE PREFERRED EMBODIMENTS

Before an embodiment of the present invention is described, concept of the temperature calculation of the present invention is explained with reference to FIG. 14.

Figure 14:
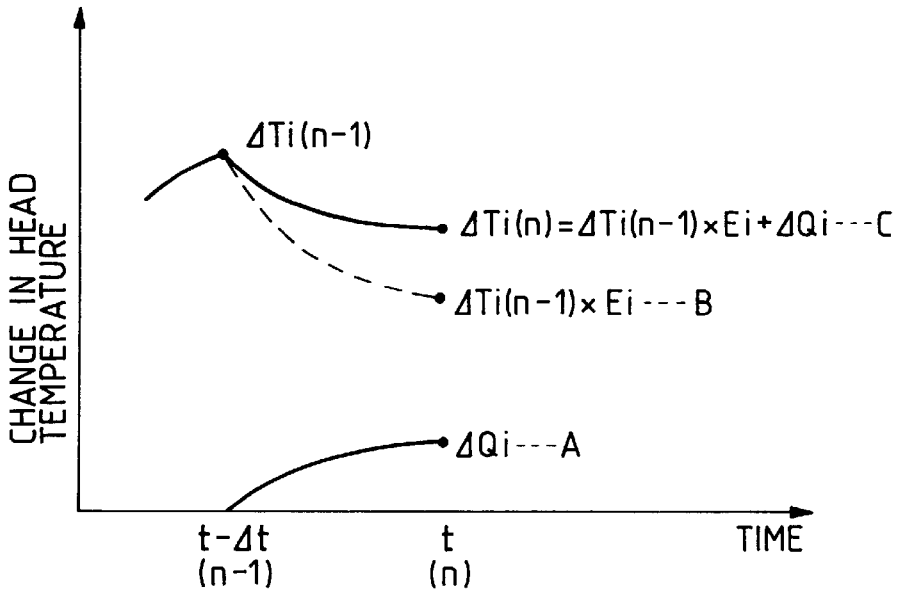
FIG. 14 illustrates concept of the present invention.

In the present invention, an object of temperature calculation is divided into i sections for each thermal time constant ($T_i$), and a quantity $\Delta Q_i$ stored as a heat in the sectioned object by an applied energy in a unit time $\Delta t$ is determined (A on FIG. 14). When an ink jet head which discharges ink by using thermal energy is the object of temperature calculation, the heat amount stored in the head is the applied thermal energy less the amount of heat dissipation by the discharged ink.

On the other hand, the stored amount after the heat dissipation from the object after the elapse of the unit time $\Delta t$ is determined by $\Delta T_i(n-1)\times\exp(-\Delta t/T_i)$ where $\Delta T_i(n-1)$ is a temperature rise of the object i at a time $(t-\Delta t)$. In the present invention, $\Delta t$ is fixed so that $\exp(-\Delta t/T_i)$ is a constant $E_i$ (B on FIG. 14). The stored heat amount by the heat application is added to the stored heat amount after the heat dissipation to determine the temperature rise $\Delta T(n)$ at a time t(n) by $\Delta T_i(n)=\Delta T_i(n-1)\times E_i+\Delta Q_i$ (C on FIG. 14). Further, $\Delta T$ (n) of the i-sectioned object is added to determine $\Delta T$.

In the following embodiment, an ink jet head is used as the object of the temperature calculation. In this case, in accordance with the present invention, the energy applied to the recording head in a unit time $\Delta t$ (calculation estimation interval) is converted to a quantity of applied heat $\Delta Q_i$ stored in the ink jet head from the drive condition for each thermal time constant $T_i$ based on the following calculation formula (1). A stored heat after the heat dissipation by the elapse of time from the stored heat $\Delta T_i(n-1)$ of the ink jet head is calculated, and the recording head chip stored heat $\Delta T_i(n)$ is stored for each thermal time constant and the applied heat amount and the heat amount after the heat dissipation are summed to calculate the temperature rise $\Delta T$ of the recording head.

$$\Delta T_i(n)=\Delta T_i(n-1)\times\exp(-\Delta t/T_i)+\Delta Q_i \quad (1)$$

$$\Delta T=\Sigma\Delta T_i(n) \quad (2)$$

By keeping the calculation interval $\Delta t$ constant, $\exp(-\Delta t/T_i)$ can assume a constant $E_i$ determined by the head structure.

Referring to the drawings, an embodiment of the present invention is now explained.

Figure 2:
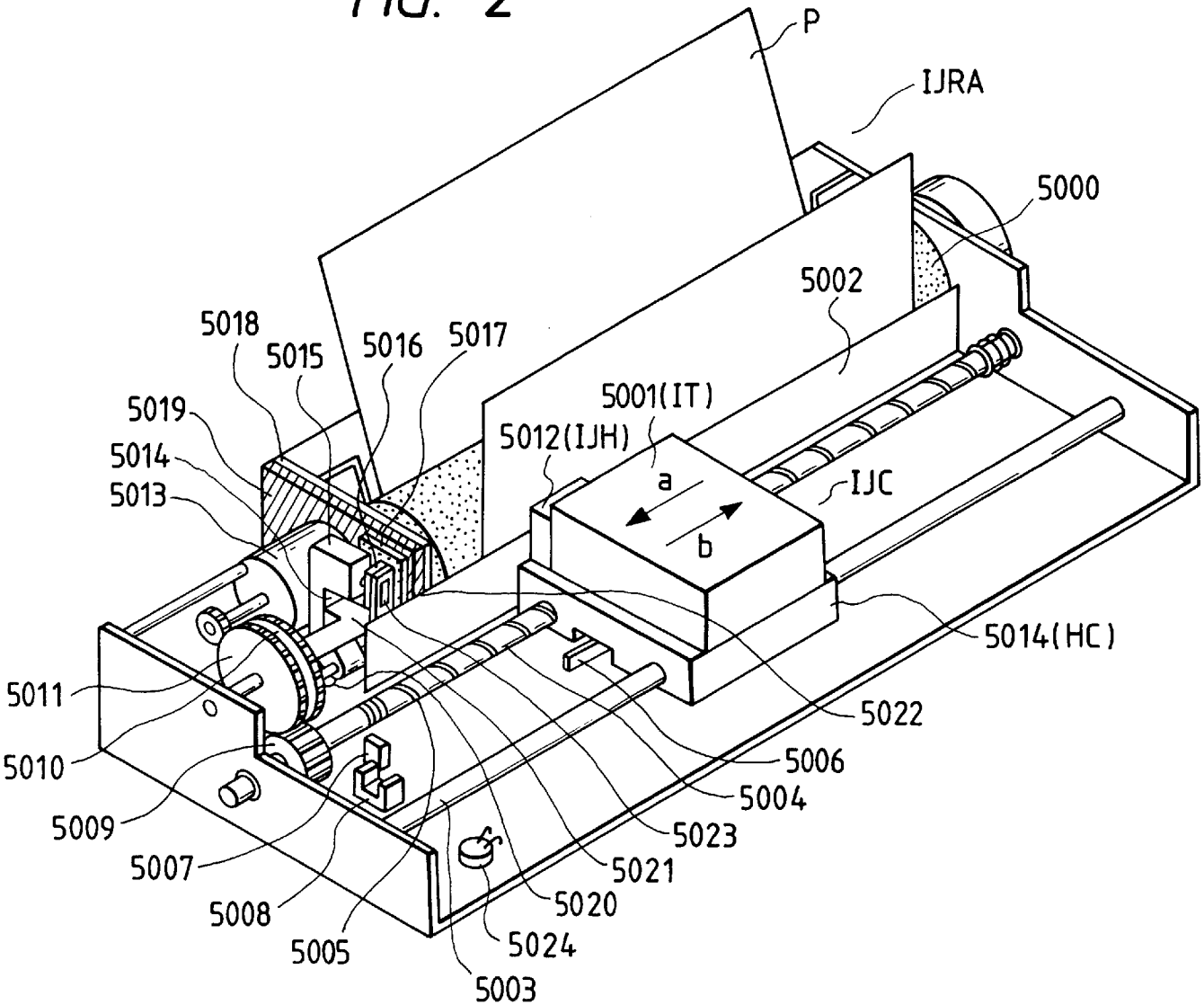
FIG. 2 shows a perspective view of a configuration of an ink jet recording apparatus suitably applied to the embodiment of the present invention.
Figure 3:
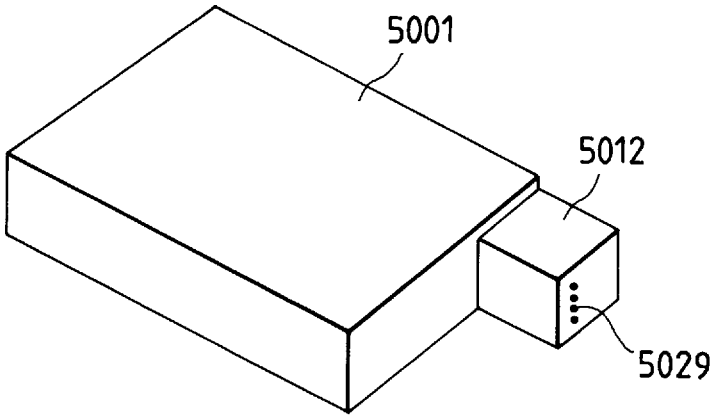
FIG. 3 shows a perspective view of a replaceable cartridge used in the apparatus of FIG. 2.

FIG. 2 shows a perspective view of a configuration of an ink jet recording apparatus IJRA to which the present invention is suitably applied. In FIG. 2, numeral 5001 denotes an ink tank (IT) and numeral 5012 denotes a recording head (IJH) connected thereto. As shown in FIG. 3, the ink tank 5001 and the recording head 5012 are integrated to form a replaceable cartridge (IJC). Numeral 5014 denotes a carriage (HC) to attach the cartridge (IJC) to a printer body and numeral 5003 denotes a guide to scan the carriage in a sub-scan direction. Numeral 5000 denotes a sheet feed roller for scanning a recording medium P in a main scan direction. Numeral 5024 denotes a temperature sensor for measuring an environment temperature in the apparatus and comprises a chip thermistor provided on an electrical packaging substrate of the recording apparatus body. A flexible cable (not shown) to pass a driving signal pulse current and a head temperature control current to the recording head 5012 is connected to a printed circuit board (not shown) having an electrical circuit (the temperature sensor 5024 etc.) for controlling the printer on the carriage 5014.

FIG. 3 shows a replaceable cartridge and numeral 5029 denotes a discharge port to discharge an ink droplet.

The ink jet recording apparatus IRJA is explained in further detail. In the recording apparatus IRJA, the carriage HC which engages with a spiral groove 5004 of a lead screw which is rotated through drive force transmission gears 5011 and 5009 in response to the forward or reverse rotation of the drive motor 5013 has a pin (not shown) and is reciprocally driven in directions a and b. Numeral 5002 denotes a retainer plate which presses the sheet to a platen 5000 over the movement path of the carriage. Numerals 5007 and 5008 denote home position detection means which detect the presence of a lever 5006 of the carriage HC in that area by a photo-coupler to switch the direction of rotation of the motor 5013. Numeral 5016 denotes a member for supporting a capping member 5022 which caps a front side of the recording head, and numeral 5012 denotes suction means for sucking the inside of the cap to recover suction of the recording head 5012 through a cap opening 5023.

Numeral 5017 denotes a cleaning blade and numeral 5019 denotes a member for forwardly and backwardly movably supporting the blade 5017. They are supported by a main body support 5018. The blade should not be limited to a specific shape but a known cleaning blade may be applied to the present embodiment. Numeral 5021 denotes a lever to start the suction for the suction recovery and it is moved as a cam 5020 engaged with the carriage HC is moved and the drive force from the drive motor is controlled by known transmission means such as a clutch.

The capping, cleaning and suction recovery are conducted at the respective positions by the action of the lead screw 5005 when the carriage HC comes to the home position area. Any construction which permits a desired operation at a desired timing may be applied to the present embodiment.

Figure 4:
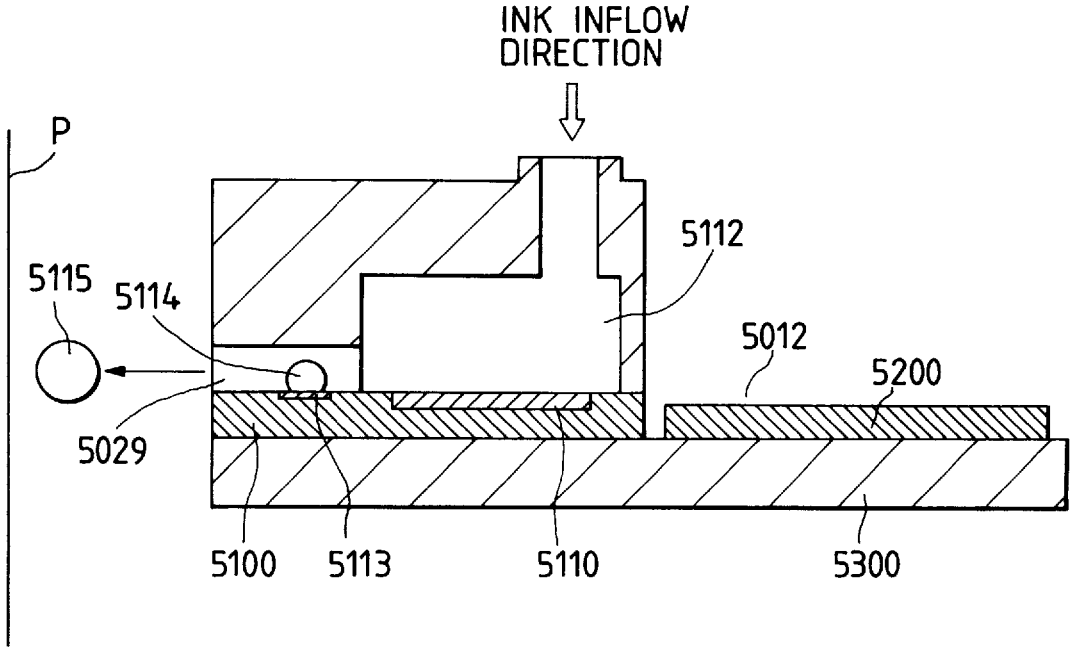
FIG. 4 shows a sectional view of a recording head of FIG. 3, FIG. 5 sows a positional relation of a discharge (main) heater and a sub-heater of the head used in the embodiment.

FIG. 4 shows a detail of the recording head 5012. A heater board 5100 formed by a semiconductor process is provided on an upper surface of a support 5300. A temperature control heater (temperature raising heater) 5110 for heating the recording head 5012 to control the temperature thereof, formed in the same semiconductor process is provided on the heater board 5100. Numeral 5200 denotes a wiring board arranged on the support 5300, on which the wiring board 5200, the temperature control heater 5110 and the discharge (main) heater 5113 are wired by wire-bonding (not shown). The temperature control heater 5110 may be a heater member formed in a separate process from that of the heater board 5100 and applied to the support 5300.

Numeral 5114 denotes bubbles generated by the heating by the discharge heater 5113. Numeral 5112 denotes a common liquid chamber for supplying the discharge ink into the recording head. Numeral 5029 denotes an ink discharge port.

Figure 5:
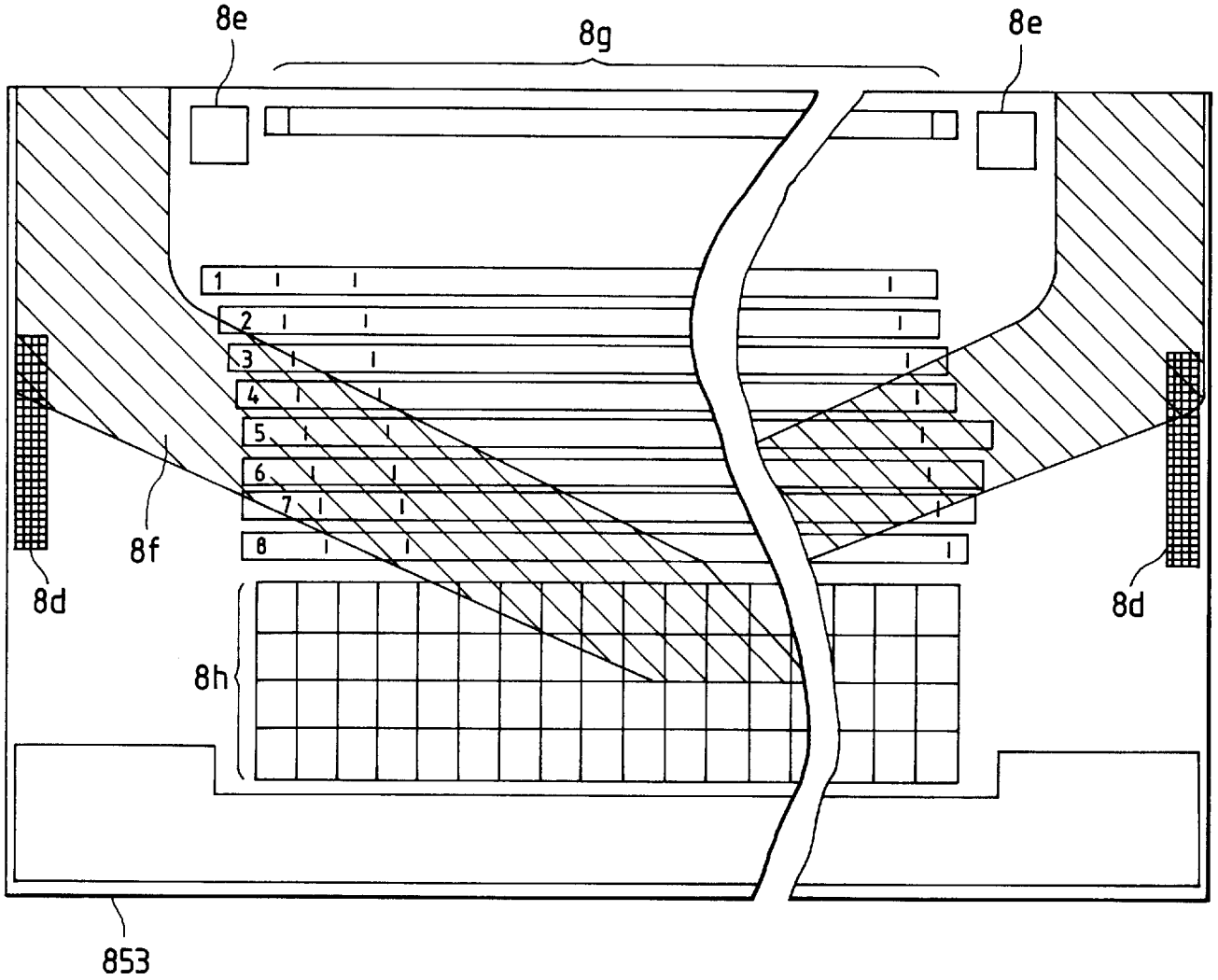

FIG. 5 shows a heater board 853 of the head used in the present embodiment. A discharge line **8*g* in which a temperature control (sub) heater 8*d* and a discharge (main) heater 8*c* are arranged and a drive element 8*h* are formed on one substrate in a positional relation shown in FIG. 5. By arranging the elements on one substrate, the head temperature can be efficiently handled and controlled, and the compactness of the head and the simplification of the manufacturing process are attained. FIG. 5 also shows a positional relation to an outer peripheral sectional plane 8*f*** of a top plate which separates the heater board into an area filled with the ink and other area.

[Embodiment 1]

Embodiment 1 of the present invention applied to the above recording apparatus is now specifically explained.

Figure 6:
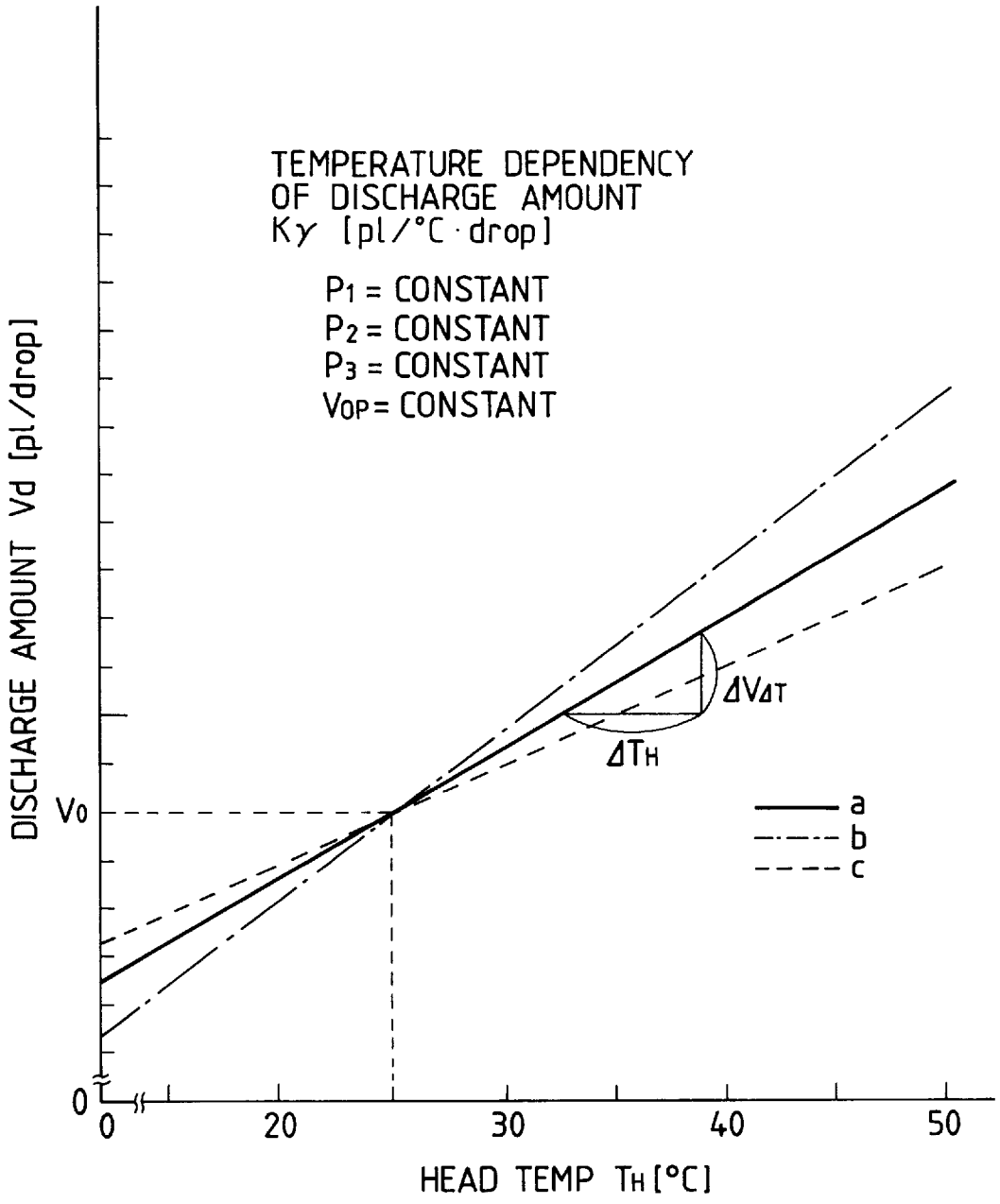
FIG. 6 shows a temperature dependency of an amount of discharge.

One of the factors to determine the discharge amount of the ink jet recording head is an ink temperature at the discharge port (which may be substituted by a recording head temperature). FIG. 6 shows a diagram showing the temperature dependency of the discharge amount when a drive pulse condition is fixed. As shown by a curve a of FIG. 6, as the recording head temperature $T_H$ (which is equal to the ink temperature of the discharge port because of a static temperature characteristic) rises, the discharge amount $V_d$ linearly increases. A gradient of the line is defined as a temperature dependency coefficient. Thus, the temperature dependency coefficient is given by $$K_T=\Delta V_{dT}/\Delta T_H[p1/^\circ\ \text{C.}\cdot\text{drop}]$$

The coefficient $K_T$ is determined by the property of the head ink regardless of the drive condition. In FIG. 6 curves b and c show the temperature dependencies of other recording heads.

In the present embodiment, the variation of the discharge amount due to the change in the ink temperature is controlled to keep the discharge amount constant by the PWM drive using the double pulses (hereinafter simply referred to as the PWM drive).

Figure 7:
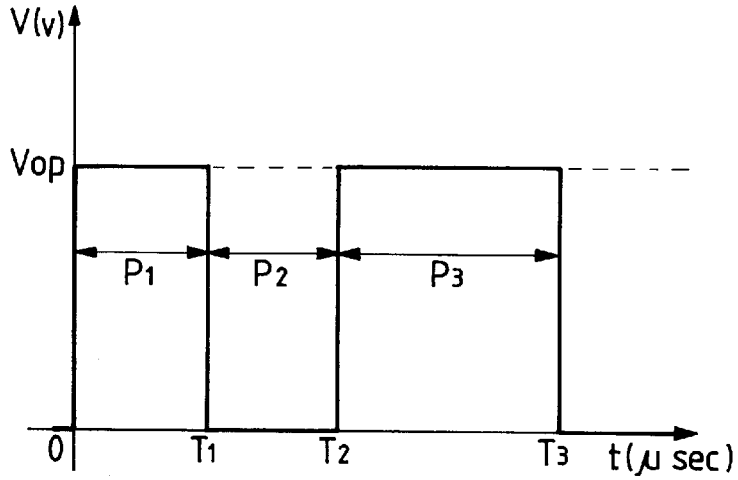
FIG. 7 illustrates PWM control.
Figure 8:
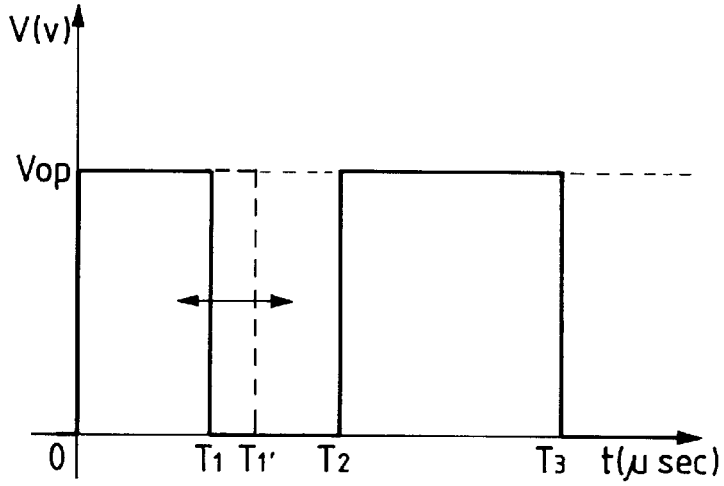
FIG. 8 illustrates pre-pulse control.
Figure 9:
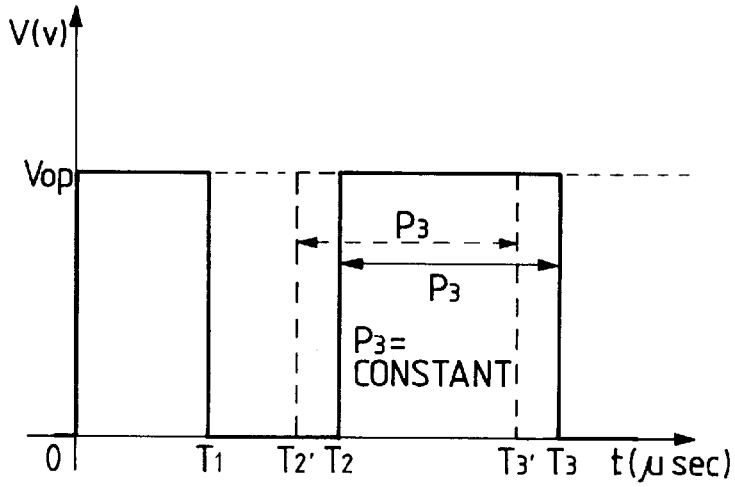
FIG. 9 illustrates interval time control.

FIG. 7 illustrates divided pulses in the present embodiment. In FIG. 7, $V_{OP}$ denotes a drive voltage applied to the discharge heater, $P_1$ denotes a pulse width of a first pulse (hereinafter referred to as a pre-pulse) of a plurality of divided heat pulses, $P_2$ denotes an interval time and $P_3$ denotes a pulse width of a second pulse (hereinafter referred to as a main pulse). $T_1$, $T_2$ and $T_3$ denote times to determine $P_1$, $P_2$ and $P_3$. The PWM discharge amount control has two major types. One is a drive method shown in FIG. 8 which is a pre-pulse width modulation drive method in which $T_2$ and $T_3$ are fixed and $T_1$ is modulated, and the other is an interval width modulation drive method in which $T_1$ and $(T_3-T_2)$ are fixed and $(T_2-T_1)$ is modulated.

Figure 10:
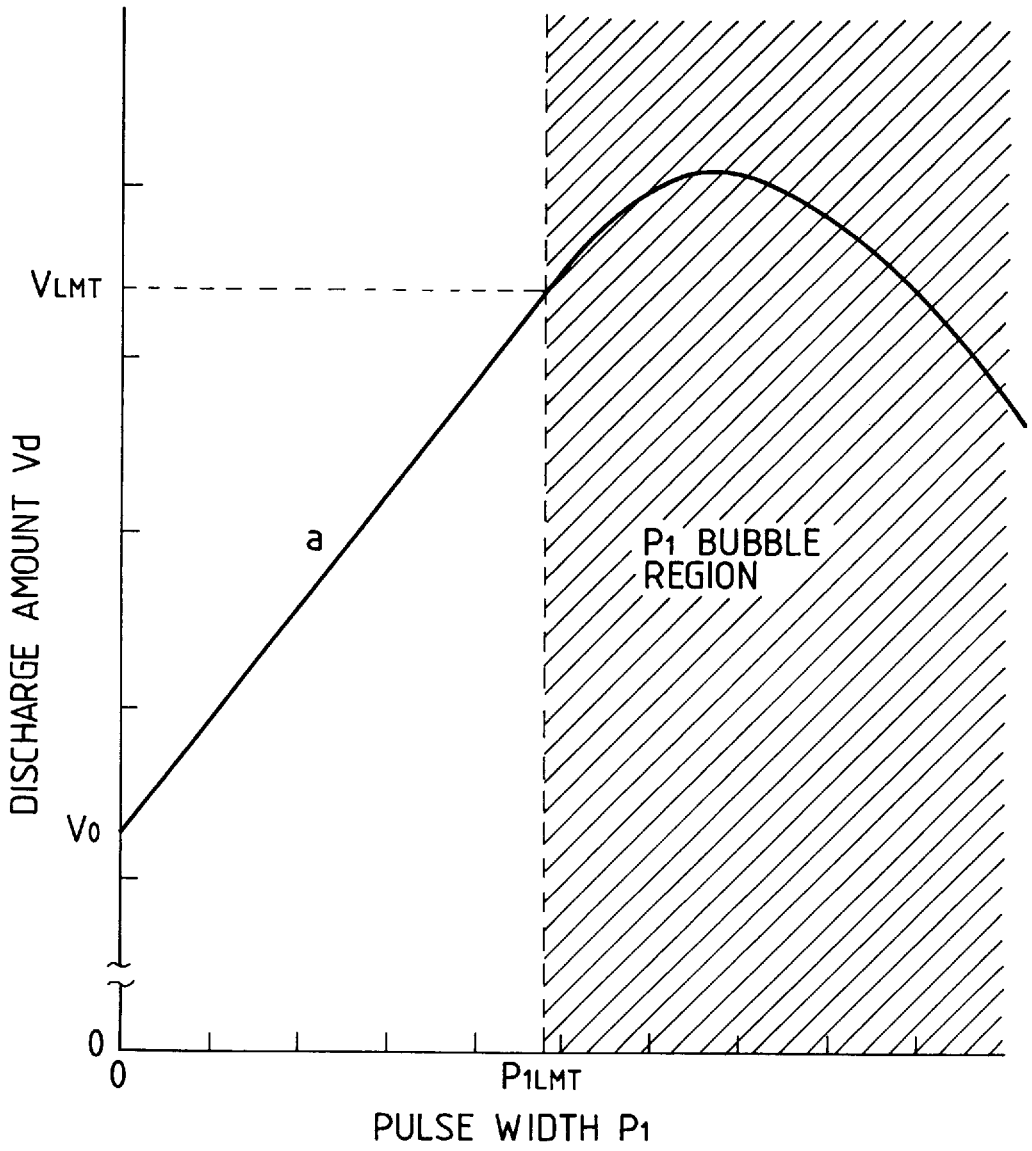
FIG. 10 shows a diagram illustrating the pre-pulse dependency of the amount of discharge.

A change of the discharge amount by the former method is shown in a diagram of FIG. 10. As $T_1$ increases, the discharge amount increases and it decreases after one peak and enters into an area in which bubbles are generated by the pulse $P_1$. In this drive method, by optimum; y setting the area of $T_1$, it is possible to linearly change the discharge amount relative to the modulation of $T_1$ and the control is easy.

Figure 11:
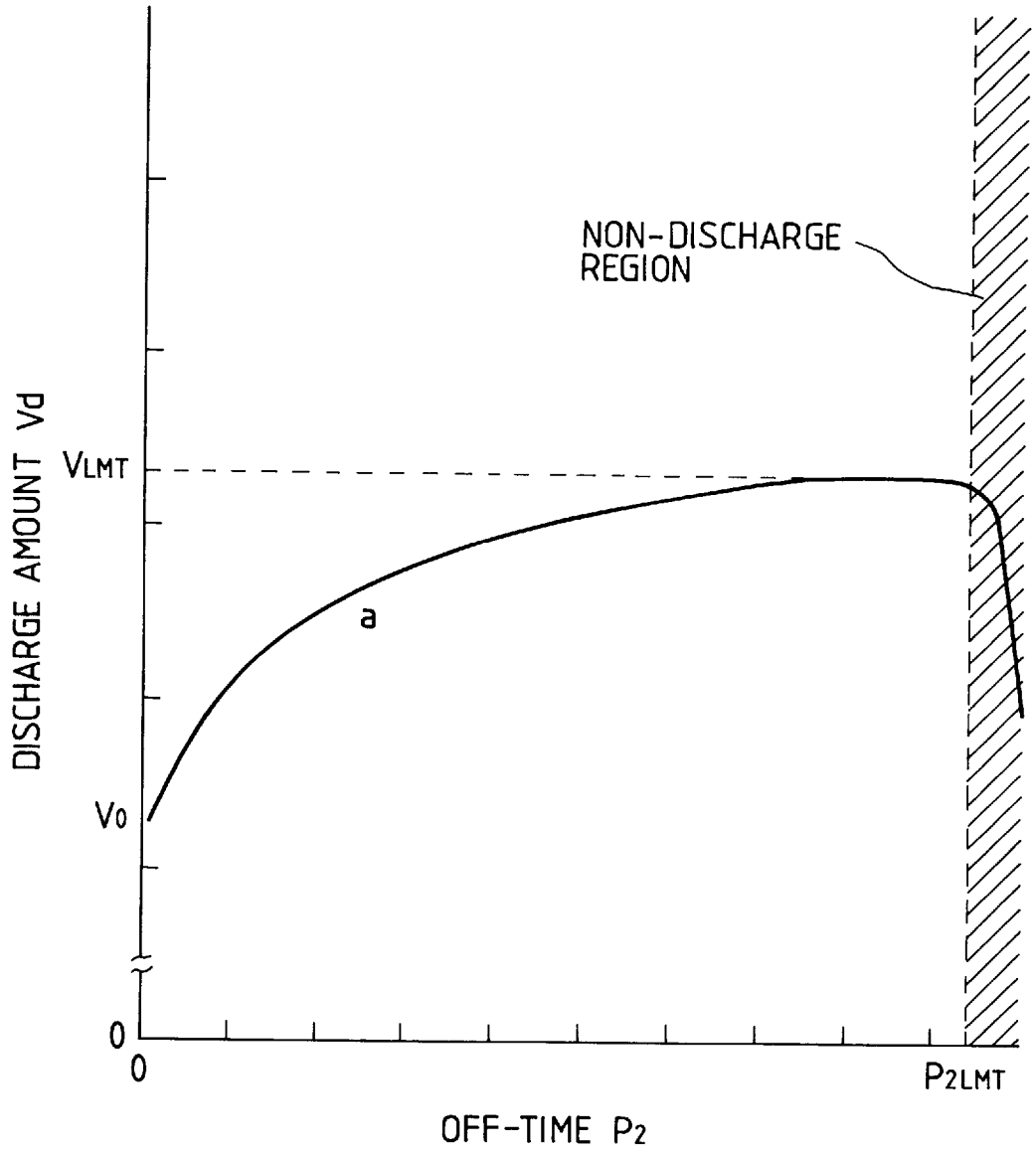
FIG. 11 shows a diagram illustrating the interval time dependency of the amount of discharge.

A change of the discharge amount by the latter control method is shown in a diagram of FIG. 11. The discharge amount increases as the interval time increases, and the generation of bubbles stops at a certain point. In this drive method, the rise of the recording head temperature is a serious problem, and when the pulse width is narrowed by a single pulse in a high temperature area and the applied energy is reduced to suppress the temperature rise, $(T_2-T_1)$ may be reduced for the increase of the temperature and $T_1$ may be reduced at the point of $(T_2-T_1)=0$ to conduct the control. Thus, the pulse waveform may be modulated with continuity. The present embodiment is compatible to any one of those drive methods or even the combination of both methods.

When the ink temperature is low, there is a limit in compensating the decrease of the discharge amount due to the low temperature by only the discharge amount increment by the PWN drive method. Thus, a low temperature heater is energized to raise the temperature of the ink to increase the discharge amount.

Figure 12:
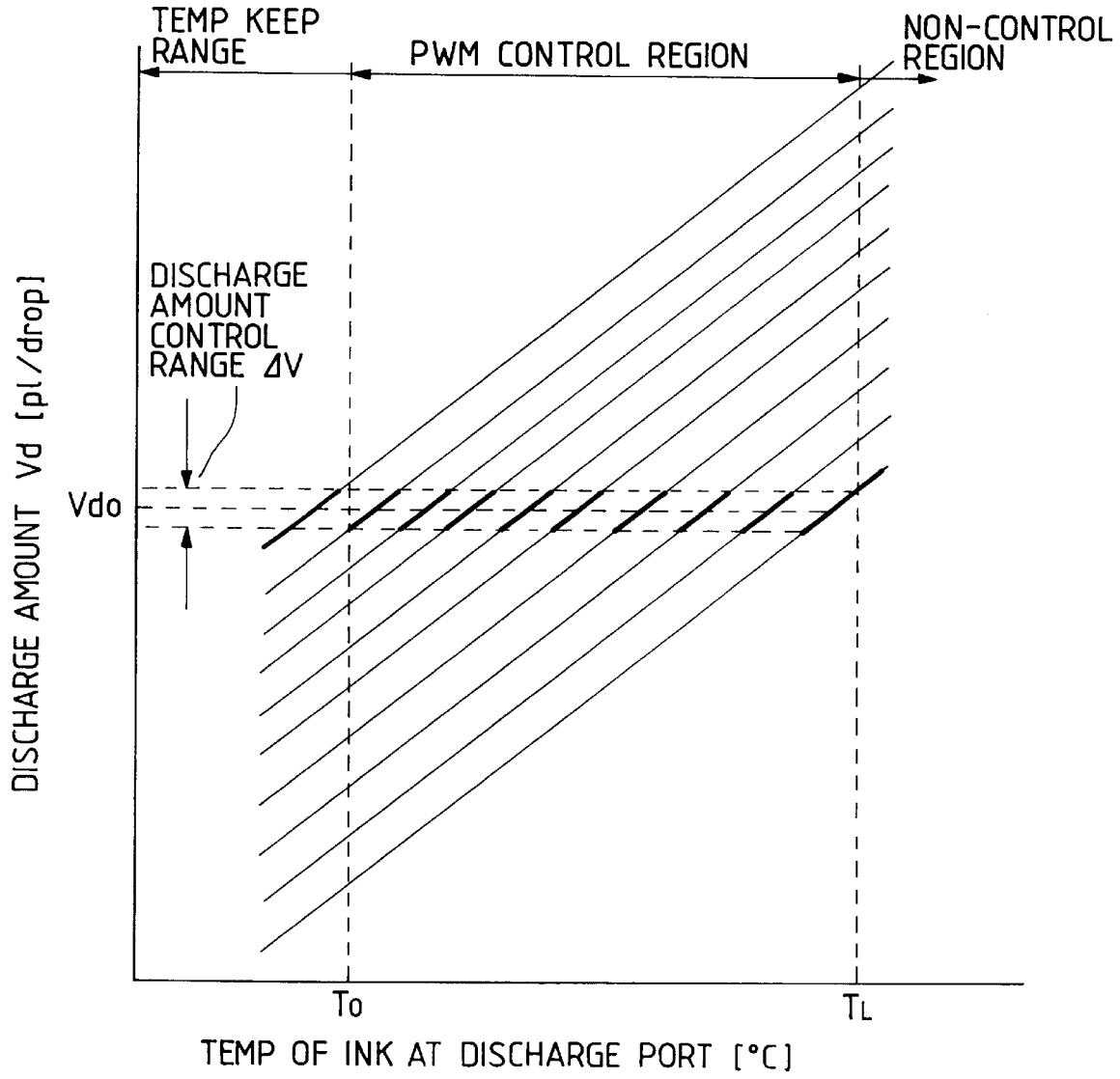
FIG. 12 illustrates amount of discharge control.

FIG. 12 shows actual control when the above relation is applied. In FIG. 12, when the temperature is lower than $T_0$ the recording head is heated by the sub-heater. Accordingly, the PWM control which control the discharge amount in accordance with the ink temperature is conducted above $T_0$. In FIG. 12, a temperature range shown by PWM area is a temperature range in which the discharge amount can be stable. In the present embodiment, the ink temperature of at the discharge port is in a range of 24° to 54° C. FIG. 12 shows a relation of the ink temperature at the discharge port and the discharge amount when the pre-pulse is changed in 11 steps. Even if the ink temperature at the discharge port changes, the discharge amount can be controlled within a width $\Delta V$ for a target discharge amount $V_{d0}$ by changing the pulse width of the pre-pulse for each temperature step width $\Delta T$ in accordance with the ink temperature.

Figure 13:
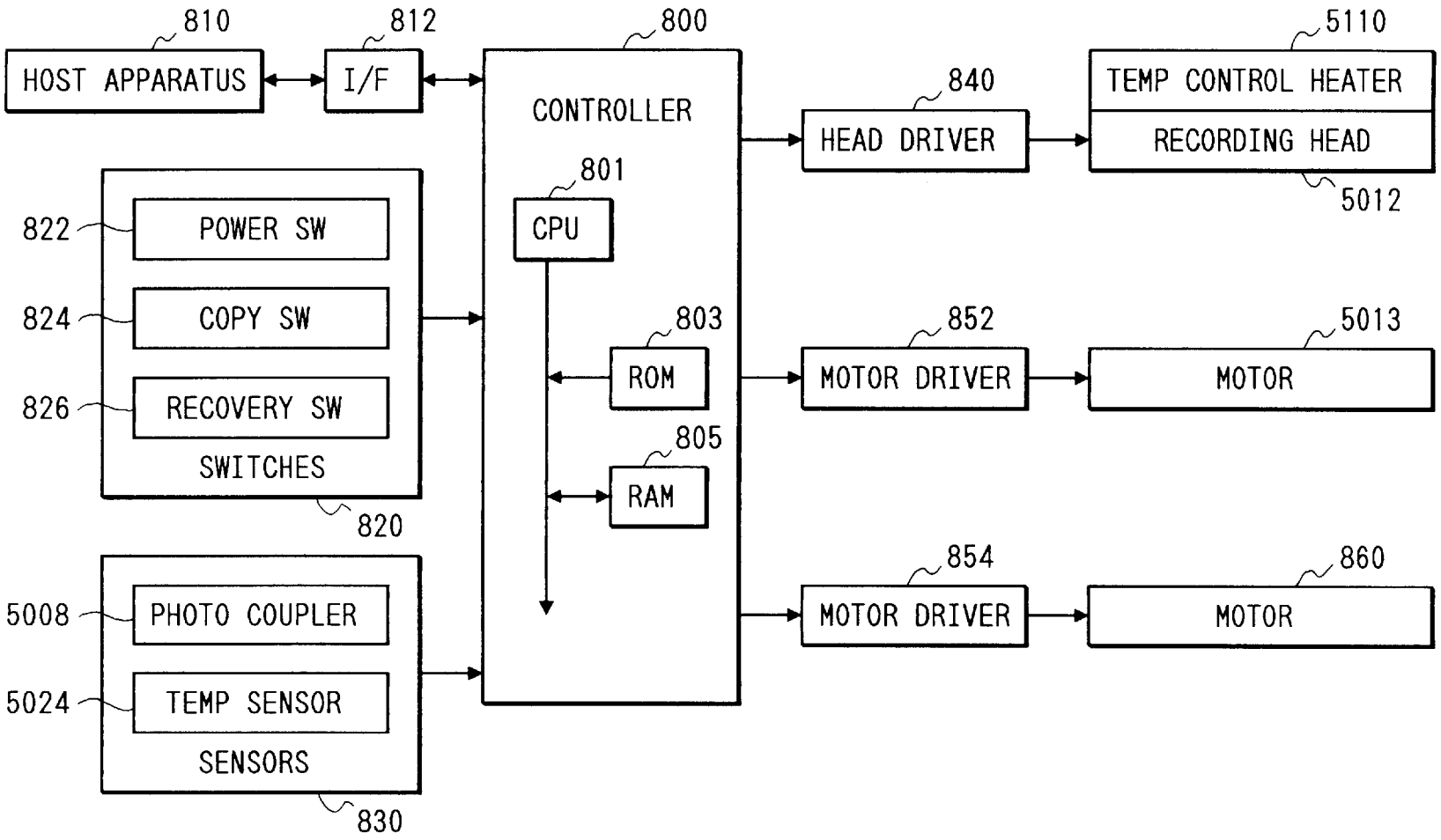
FIG. 13 shows a block diagram of a configuration of a control unit of the apparatus shown in FIG. 2.

FIG. 13 shows a block diagram of a configuration of a control unit of the ink jet recording apparatus.

Figure 1:
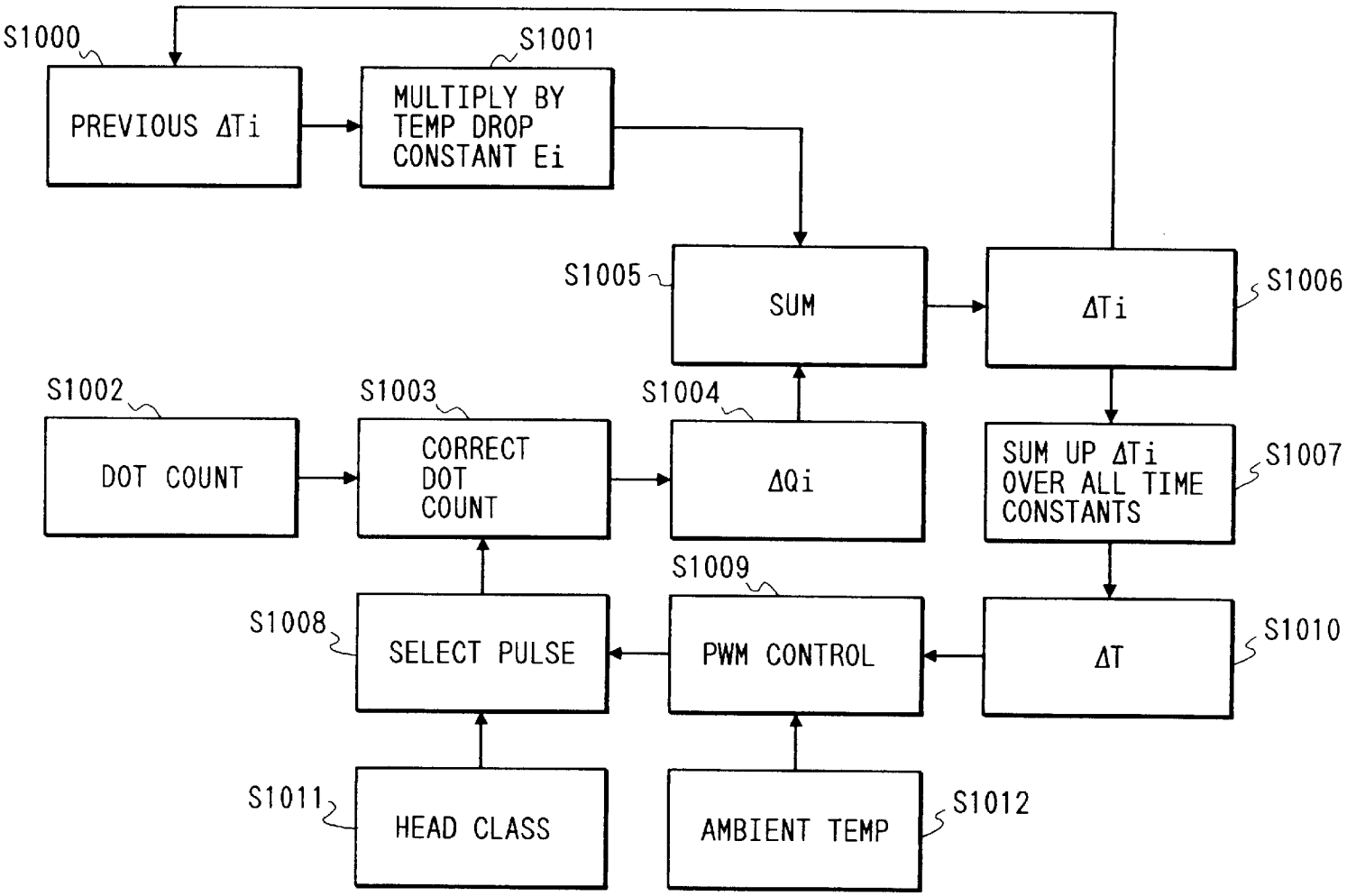
FIG. 1 shows a block diagram of a feedback control system using a temperature estimation calculation or a control process procedure therefor in accordance with an embodiment of the present invention.

Numeral 800 denotes a controller which is a main control unit which includes a CPU 801 in a form of microcomputer for executing the sequence shown in FIG. 1, a ROM 803 for storing a program for the above sequence, a necessary table and other fixed data, and a RAM 805 having an area to develop image data and a working area. Numeral 810 denotes a host system which is a source of supply of the image data (which may be an image reader), and the image data and other commands and status signals are transmitted to and received from the controller through an interface (I/F) 812.

Numeral 820 denotes a group of switches for permitting entry of command by an operator such as a power switch 822, a copy switch 824 for commanding the start of record (copy) and a recovery switch 826 for commanding the start of the suction recovery. Numeral 830 denotes a group of sensors for detecting the status of the apparatus such as a photo-coupler 5008 for detecting the home position and a temperature sensor 5024.

Numeral 840 denotes a head driver for driving the discharge heater of the recording head in accordance with the record data. Numeral 852 denotes a drive for driving a motor 5013 used to drive the carriage 5014 in the main component direction (left and right directions in FIG. 2). Numeral 860 denotes a sub-scan motor used to transport (sub-scan) the recording medium P, and numeral 854 denotes a driver therefor.

FIG. 1 shows a temperature estimation calculation system or procedure in the present embodiment. Blocks shown in FIG. 1 may be constructed as the process procedure conducted by the controller 800, or at least a portion thereof may be constructed by hardware using a logic circuit.

In the present embodiment, the calculation interval $\Delta t$ is fixed (50 msec in the present example) so that $\exp(-\Delta t/T_i)$ is set to a constant $E_i$ determined by the structure of the head (hereinafter, this constant is referred to as a temperature drop constant). Accordingly, a sum of a product of the previous calculation result and the temperature drop constant and the heat amount applied during the calculation interval is always updated for each thermal time constant by the formula (1) and a total sum of $\Delta T_i$ of the respective time constants by the formula (2) is set as the head temperature $\Delta T$.

Referring to FIG. 1, the calculation circuit of the present embodiment is explained. The previous $\Delta T_i$ (corresponding to $\Delta T_i(n-1)$) derived in step S1000 is multiplied by the temperature drop constant $E_i$. On the other hand, the applied heat amount $\Delta Q_i$ of the unit calculation interval $\Delta t$ is calculated in the following manner. In step S1002, dots in the unit calculation interval $\Delta t$ are counted. In the present example, one line comprises 2880 dots and the drive time per dot is 160 $\mu$sec. Thus, in the unit time $\Delta t$ (50 msec), 312.5 columns of dots are counted. Accordingly, one line is divided into 9.2. The number of discharge ports of the head is 128. The pulse used for the head temperature by the temperature increment $\Delta T$ of the head and the environment temperature is determined by the PWM control (step S1009) described above. Since the resistance of the heater varies from head to head because of a variance in the manufacture of the head, the applied energy required for the discharge varies. Thus, the heads are classified by the energy and the pulses to be used for the PWM control are determined in accordance with the class. When the drive pulse and the drive voltage which are drive conditions to the recording head are fixed, the heat amount applied to the recording head member for each time constant is substantially proportional to the number of heats, that is, the number of dots in the unit time so long as the unit time is sufficiently short.

In the present embodiment, a basic pulse is set and $\Delta Q_i$ corresponding to a discharge duty which is the dot count per unit time using the basic pulse is prepared for each thermal time constant. When the discharge duties per unit time are equal, $\Delta Q_i$ is made constant in accordance with the width (application time) of the drive pulse of the head. Accordingly, a ratio of the basic pulse and the other pulse is set as a weight and as many tables for simultaneously selecting the weights by the drive pulse used and the basic pulse as the number of classes of the recording heads are prepared. When the weight is given by k, k=1 for the basic drive pulse and since $\Delta Q_1$ is substantially linear to the discharge duty, the weight is multiplied to the dot count per unit time. $\Delta Q_i$ derived from the table may be corrected to $k\times\Delta Q_i$.

In step S1003 of FIG. 1, the dot count is corrected by the drive pulse, and in step S1004, $\Delta Q_i$ is derived by using the discharge duty $\Delta Q_i$ table. The calculation result of the step S1001 and $\Delta Q_i$ are summed in step S1005 to derive the head temperature $\Delta T_i$ (corresponding to $\Delta T_i(n)$) for each thermal time constant in step S1006. $\Delta T_1$ is stored for use in the next calculation. In step S1007, $\Delta T_i$ for all thermal constants are summed to derive the head temperature $\Delta T$ in step S1010. Since the head temperature $\Delta T$ is the temperature increment from the environment temperature of the head, the absolute temperature of the head is a sum of the environment temperature and $\Delta T$. In step S1009, the PWM control is conducted to select the pulse to be used by the absolute temperature of the head. Namely, the switching of the drive pulse by the PWM control is done at the unit time interval of the estimation calculation.

In the present embodiment, as many heat store status of the head as the number i of thermal time constants handled in heating the recording head are stored as $\Delta T_i$ and $\Delta T_i$ may be updated for each calculation. Thus, it is not necessary to store a large volume of history of the head heating and the estimation may be made by a calculation with a low load. In the ink jet recording system of the present embodiment, the correlation of the energy applied to the recording head and the stored heat amount does not correspond one to one and the temperature estimation of the recording head and the PWM drive are combined to uniquely decide the drive conditions such as the drive pulse to the recording head and the drive voltage. The heat amount to be applied to the recording head under the above conditions is stored in the table to permit the estimation of the temperature of the recording head and control the discharge amount to a predetermined range.

The drive of the sub-heater in the constant temperature control may also be done by preparing a table for determining $\Delta Q_i$ from a duty of activation time at the calculation interval as it is for the discharge heater. Even if the sub-heater and the heater are mixed at the unit time interval of the calculation or simultaneously present, $\Delta Q_i$ and $\Delta Q_i'$ by the respective heaters are determined and they are summed to produce $\Delta Q_i$ so that the above calculation is conducted.

For the sub-heater, since substantially no condition is imposed to the heat by one pulse unlike the discharge heat, it is sufficient to watch the number of times of heat in the unit time by keeping the equal heat amount applied by one time of heat (one pulse) and the weighing is not required this is attained by imposing a heat pulse condition which makes the applied heat amount by one time of heat (one pulse) equal for the head class.

In accordance with the present embodiment, as many heat store status of the head as the number of thermal time constants are stored as $\Delta T_i$ and operated by merely increasing the addition of $\Delta Q_i$ even when the sub-heater is used and the load to the calculation does not reach double of the load when the sub-heater is not used.

[Embodiment 2]

Figure 15:
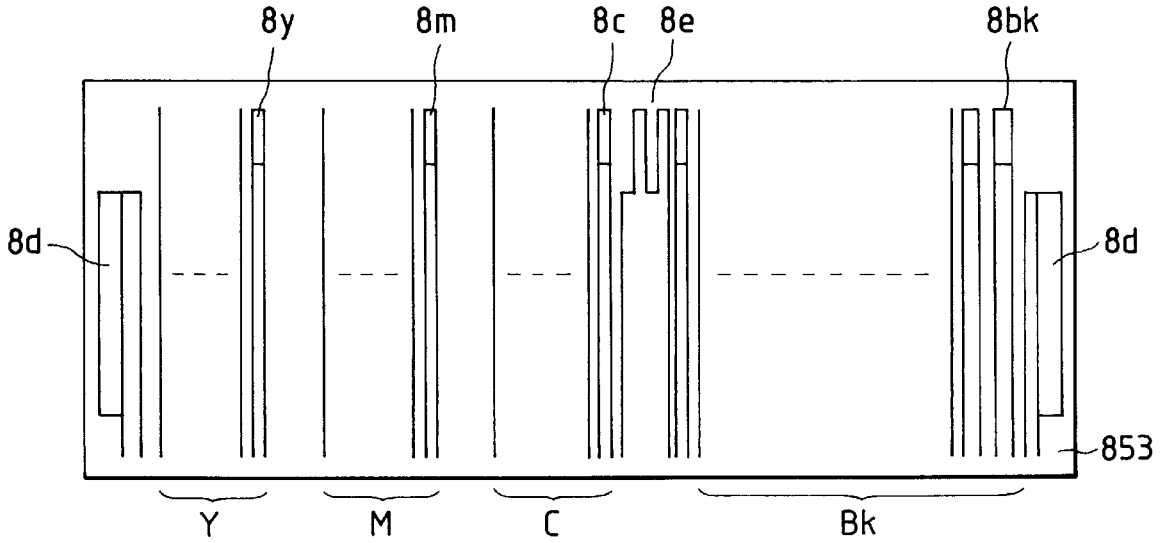
FIG. 15 shows a configuration of a head to which the present invention is applicable.

In the present embodiment, the temperature of the recording head having discharge heaters of different types (j types where $j \geqq 2$) on one chip. FIG. 15 shows discharge heaters 8*y*, 8*m* and 8*c* for discharging Y, M and C inks and a discharge heater 8*bk* for discharging Bk ink. The discharge heater 8*bk* for the Bk ink has a larger area to provide a larger amount of discharge.

In the present embodiment, the number of heat dots in the unit calculation interval is counted for each type of discharge heater (two types in the present embodiments) and $\Delta Q_i$ ($\Delta Q_{ji}$) in the previous embodiment is called. A sum of $\Delta Q_i(\Delta Q_{ji})$ of the respective types are summed and it is used as the applied heat amount $\Delta Q_i$ per unit time to conduct the estimation calculation of the previous embodiment. Thus, the same control as that of the previous embodiment is attained.

[Embodiment 3]

The present embodiment attains the temperature estimation of the head having an elongated recording head chip and a number of discharge heaters. When the head chip is long, a thermal gradient is generated depending on the position on the chip so that it cannot be handled as one material.

In the present embodiment, the recording head is grouped by the position of the discharge heater of the recording head. The grouping is preferably made by uniformly.

In the present embodiment, the head chip is divided into two for simplicity. The temperature estimation calculation is done for the two groups a and b by modifying the formula (1) as follows:

$$\Delta T_{ia}(n)=\Delta T_{ia}(n-1)\times\exp(-m_i\times\Delta t)+\Delta Q_{ia}+\Delta q_{ai} \quad (3)$$

$$\Delta T_{ib}(n)=\Delta T_{ib}(n-1)\times\exp(-m_i\times\Delta t)+\Delta Q_{ib}+\Delta q_{bi} \quad (4)$$

In the formulae (3) and (4), the correction terms $\Delta q_i(\Delta q_{ai}, \Delta q_{bi})$ are added to the formula (1).

$\Delta q_i$ considers the mutual interference between the two groups a and b formed by the members of the time constants $T_i$ with a flow from an adjacent group being positive. $\Delta q_{ai}$ and $\Delta q_{bi}$ are determined from the following formulae to determine a temperature gradient between the groups.

$$\Delta q_{ai}=\alpha_i\times(\Delta T_{ib}(n-1)-\Delta T_{ia}(n-1)) \quad (5)$$

$$\Delta q_{bi}=\alpha_i\times(\Delta T_{ia}(n-1)-\Delta T_{ib}(n-1)) \quad (6)$$

$\alpha_i$ determined by the members and the time interval $\Delta t$ and it is a constant in the present embodiment.

In the present embodiment, the number of heats in the unit time interval $\Delta t$ in each group is counted and $\Delta Q_{ia}$ and $\Delta Q_{ib}$ are derived by using the table for converting the heat count to $\Delta Q_{ia}$ and $\Delta Q_{ib}$ as they are in the previous embodiment. The multiplication of the temperature drop constant ($\exp(-m_i\times\Delta t)$) is conducted based on the previous estimation calculation results $\Delta T_{ia}(n-1)$ and $\Delta T_{ib}(n-1)$ as it is in the previous embodiment. The formula (5) is also calculated to determine $\Delta q_i$. They are summed to derive the stored heat $\Delta T_{ia}(n)$ and $\Delta T_{ib}(n)$ in each member group. They are operated by $$\Delta T=\Sigma\Delta T_{ai},$$

$$\Delta T_b=\Sigma\Delta T_{bi} \quad (7)$$

to derive the temperature in each group.

The head temperature in each group is derived from the calculation result and the PWM drive is made for each group. Thus, the variation of discharge amount caused by the temperature distribution in the head chip is eliminated.

In accordance with the present invention, the ink jet head drive pulse is PWM controlled in accordance with the calculation result of the recording head chip temperature to estimate the temperature and control the discharge amount at the ink jet head at a high speed and a high precision. In the present embodiment, the control of the discharge amount is explained as the control based on the temperature calculation although the present invention is not limited thereto. In the present invention, the constant temperature control of the head and the control of the recovery condition such as the condition for preliminary discharge or wiping may be conducted based on the calculated temperature.

The present invention is particularly suitable for use in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat. No. 4,723,129 and U.S. Pat. No. 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through an discharge port to produce at least one droplet. The driving signal is preferably in the form of pulse because the development and the contraction of the bubbles can be effected instantaneously, and therefore the liquid (ink) is ejected with fast response. The driving signal is preferably such as those disclosed in U.S. Pat. No. 4,463,359 and U.S. Pat. No. 4,345,262 In addition, the temperature rise rate of the heating surface is preferably such as those disclosed in U.S. Pat. No. 4,313,124.

The structure of the recording head may be those shown in U.S. Pat. No. 4,558,333 and U.S. Pat. No. 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the discharge port for a plurality of electro-thermal transducers, and the structure disclosed in Japanese Laid-Open Patent Application No. 59-138461 in which an opening for absorbing a pressure wave of thermal energy is formed corresponding to the discharge port. This is because the present invention is effective to preform the recording with certainty and high efficiency irrespective of the type of the recording head.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provisions of the recovery means and/or the auxiliary means for the preliminary operation are preferable because they further stabilize the effects of the present invention. As for such means, there are capping means for the recording head, cleaning means therefor, pressing or sucking means, preliminary heating means which may be an electro-thermal transducer, an additional heating element or a combination thereof. Also, means for effecting preliminary discharge (not for the recording) may stabilize the recording operation.

As regards the variation of the recording head mountable, it may be a single head for a single color or plural heads for a plurality of inks having different colors or densities. The present invention is effectively applicable to an apparatus having at least one of a monochromatic mode mainly with black, a multi-color mode with different color inks and/or full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of now lower than 30° C. and not higher than 70° C. to stabilize the viscosity of the ink to provide the stable discharge in a conventional recording apparatus of this type, the ink may be such that it is liquid within the temperature range when the recording signal is applied. The present invention is applicable to other type of ink. In one of them, the temperature rise due to the thermal energy is positively prevented by consuming it for the state change of the ink from the solid state to the liquid state. Another ink is solidified when it is left, to prevent the evaporation of the ink. In any case, the application of the recording signal producing thermal energy, the ink is liquefied, and the liquefied ink may be discharged. Another ink may start to be solidified at the time when it reaches the recording sheet.

The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

While the invention has been described with reference to the structures disclosed herein, it is not confined to the details set forth and the present invention is intended to cover such modifications or changes as may come within the objects of the improvements or the scope of the claims.

What is claimed is:

1. An ink jet apparatus which uses an ink jet head which has a heat generating element for generating thermal energy to be used to discharge ink, the ink jet head having a plurality of thermal time constants, comprising:

deriving means for deriving an amount $\Delta Q_i$ indicative of a heat amount stored in a predetermined time interval $\Delta t$ in $i(i \geqq 1)$ portions of said ink jet head sectioned according to types of the thermal time constants, accompanied with the heat generated by the driving of said ink jet head;

multiplying means for multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant to obtain a product, and wherein $n \geqq 1$;

adding means for adding the amount $\Delta Q_i$ to a value obtained by multiplication by means of said multiplying means;

storing means for storing a value obtained by addition by means of said adding means as the amount $\Delta T_i(n)$ indicative of the heat amount stored in the sectioned i-th portion;

summing means for summing all the amounts $\Delta T_i(n)$ to determine an amount $\Delta T$ corresponding to the heat amount stored in said ink jet head; and controlling means for controlling said ink jet head in accordance with the amount $\Delta T$.

2. An ink jet apparatus according to claim 1 wherein said control means changes a drive condition of said ink jet head in accordance with the amount $\Delta T$ at said predetermined time interval.

3. An ink jet apparatus according to claim 2 further comprising means for detecting an ambient temperature of said ink jet head;

wherein said control means changes the drive condition of said ink jet head in accordance with the ambient temperature.

4. An ink jet apparatus according to claim 1 further comprising:

means for measuring a number of times of discharge of said ink jet head in said predetermined time interval $\Delta t$; and means for converting the number of times of discharge to the amount $\Delta Q_i$.

5. An ink jet apparatus according to claim 1, further comprising a plurality of heat generating elements, and wherein each said heat generating element is a one of a plurality of different types, and wherein said measurement means measures the number of times of discharge of said ink jet head for each said type of said heat generating element (a number of said types being represented by $j(j \geqq 2)$), and further comprising conversion means for converting the number of times of discharge in said predetermined time interval $\Delta t$ to the amount $\Delta Q_{ji}$ for each said type of heat generating element and sets a sum of the amount $\Delta Q_{ji}$ for each i as the amount $\Delta Q_i$.

6. An ink jet apparatus according to claim 2 further comprising:

measurement means for measuring a number of times of discharge of said ink jet head in said predetermined time interval $\Delta t$; and means for converting the number of times of discharge to the amount $\Delta Q_i$.

7. An ink jet apparatus according to claim 6 wherein said measurement means corrects the number of times of discharge of said ink jet head in said predetermined time interval $\Delta t$ by the drive condition of said ink jet head.

8. An ink jet apparatus according to claim 6 wherein said heat generating element has a characteristic and said measurement means corrects the number of times of discharge of said ink jet head in said predetermined time interval $\Delta t$ by the characteristic of said heat generating element.

9. An ink jet apparatus according to claim 1 further comprising:

a heater for heating said ink jet head;

measuring means for measuring an electric power supplied to said heater in the predetermined time interval $\Delta t$; and means for converting the supplied electric power to an amount $\Delta Q_i'$ indicative of the heat amount stored in the i-sectioned portion by said heater; wherein said derive means derives the amount $\Delta Q_i$ in accordance with the amount $\Delta Q_i'$.

10. An ink jet apparatus which uses an ink jet head which has a plurality of heat generating elements for generating thermal energy to be used to discharge ink, the ink jet head having a plurality of thermal time constants, comprising:

dividing means for dividing said heat generating elements arranged in the ink jet head into groups in accordance with an arrangement position of the heat generating elements and deriving an amount $\Delta Q_i$ indicative of a heat amount stored in a predetermined time interval $\Delta t$ in i ($i \geqq 1$) portions of said ink jet head sectioned according to types of the thermal time constants, accompanied by the heat generated by the driving of said ink jet head, independently for each group;

multiplying means for multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant to obtain a product, where $n \geqq 1$;

multiplying means for multiplying a difference between the stored heat amounts $\Delta T_i(n-1)$ between adjacent groups of said ink jet head to calculate a correction amount $\Delta q_i$;

summing means for summing the amount $\Delta Q_i$, the correction amount and a value obtained by multiplication by means of said multiplying means to calculate a sum for each group, storing means for storing a value obtained by addition by means of said adding means as the amount $\Delta T_i(n)$ indicative of the heat amount stored in the sectioned i-th portion for each group of said ink jet head;

summing means for summing all the amounts $\Delta T_i(n)$ to determine an amount $\Delta T$ corresponding to the heat amount stored in each group of said ink jet head; and controlling means for controlling the groups of said ink jet head in accordance with the amount $\Delta T$.

11. An ink jet apparatus according to claim 10 wherein said control means changes a drive condition of said ink jet head in accordance with the amount $\Delta T$ at said predetermined time interval.

12. An ink jet apparatus according to claim 11 further comprising means for detecting an ambient temperature of said ink jet head;

wherein said control means changes the drive condition of said ink jet head in accordance with the ambient temperature.

13. An ink jet apparatus according to claim 10 further comprising:

means for measuring a number of times of discharge of said ink jet head in said predetermined time interval for each group; and means for converting the number of times of discharge to the amount $\Delta Q_i$.

14. An ink jet apparatus according to claim 11 further comprising:

means for measuring a number of times of discharge of said ink jet head in said predetermined time interval for each group; and means for converting the number of times of discharge to the amount $\Delta Q_i$.

15. An ink jet apparatus according to claim 14 wherein said measurement means corrects the number of times of discharge of each group of said ink jet head in said predetermined time interval $\Delta t$ by the drive condition of each group of said ink jet head.

16. An ink jet apparatus according to claim 14 wherein each said heat generating element has a characteristic and said measurement means corrects the number of times of discharge of each group of said ink jet head in said predetermined time interval $\Delta t$ by the characteristic of said heat generating element of each group of said ink jet head.

17. A control method for an ink jet head having a plurality of heat generating elements, each for generating thermal energy to be used to discharge ink, the ink jet head having a plurality of thermal time constants, comprising:

a step of deriving an amount $\Delta Q_i$ indicative of a heat amount stored in a predetermined time interval $\Delta t$ in i ($i \geqq 1$) portions of said ink jet head sectioned according to types of the thermal time constants, accompanied by the heat generated by the driving of said ink jet head;

a step of multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant, where $n \geqq 1$;

a step of adding the amount $\Delta Q_i$ to a value obtained by multiplication in said multiplying step;

a step of storing a value obtained by addition in said adding step as the amount $T_i(n)$ indicative of the heat amount stored in the sectioned i-th portion;

a step of summing all the amounts $\Delta T_i(n)$ to determine an amount $\Delta T$ corresponding to the heat amount stored in said ink jet head; and a step of controlling said ink jet head in accordance with the amount $\Delta T$.

18. A control method according to claim 17 wherein said control step changes a drive condition of said ink jet head in accordance with the amount $\Delta T$ at said predetermined time interval.

19. A control method according to claim 18 further comprising a step of detecting an ambient temperature of said ink jet head;

wherein said control step changes the drive condition of said ink jet head in accordance with the ambient temperature.

20. A control method according to claim 17 further comprising:

a step of measuring number of times of discharge of said ink jet head in said predetermined time interval $\Delta t$; and a step of converting the number of times of discharge to the amount $\Delta Q_i$.

21. A control method according to claim 17 wherein said head further comprises a plurality of heat generating elements, and each said heat generating element is a one of a plurality of different types, and wherein said measurement step measures the number of times of discharge of said ink jet head for each said type of said heat generating elements (the number of types represented by $j(j \geqq 2)$), and said conversion step converts the number of times of discharge in said predetermined time interval $\Delta t$ to the amount $\Delta Q_{ji}$ for each said type of heat generating element and setting a sum of the amount $\Delta Q_{ji}$ for each i as the amount $\Delta Q_i$.

22. An ink jet apparatus according to claim 18 further comprising:

a step of measuring a number of times of discharge of said ink jet head in said predetermined time interval $\Delta t$; and a step of converting the number of times of discharge to the amount $\Delta Q_i$.

23. A control method according to claim 22 wherein each said heat generating element has a characteristic and said measurement step corrects the number of times of discharge of said ink jet head in said predetermined time interval $\Delta t$ by the drive condition of said ink jet head.

24. A control method according to claim 22 wherein said measurement step corrects the number of times of discharge of said ink jet head in said predetermined time interval $\Delta t$ by a characteristic of said heat generating element.

25. A control method according to claim 17 further comprising:

a step of measuring an electric power supplied to a heater for heating said ink jet head in the predetermined time interval $\Delta t$; and a step of converting the supplied electric power to an amount $\Delta Q_i'$ indicative of the heat amount stored in the i-sectioned portion by said heater;

wherein said derive step derives the amount $\Delta Q_i$ in accordance with the amount $\Delta Q_i'$.

26. An ink jet method for use in an ink jet apparatus which uses an ink jet head which has a heat generating element for generating thermal energy to be used to discharge ink, the ink jet head having a plurality of thermal time constants, comprising:

a step of dividing discharge heaters arranged in the ink jet head into groups in accordance with the arrangement position of the discharge heaters and deriving an amount $\Delta Q_i$ indicative of a heat amount stored in a predetermined interval $\Delta t$ in i $(i \geqq 1)$ portions of said ink jet head sectioned according to types of the thermal time constants, accompanied by the heat generated by the driving of said ink jet head, independently for each group;

a step of multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant;

a step of multiplying a difference between the stored heat amounts $\Delta T_i(n-1)$ between adjacent groups of said ink jet head to calculate a correction amount $\Delta q_i$;

a step of summing the amount $\Delta Q_i$, the product and the correction amount and a value obtained by multiplication in said multiplying step to calculate a sum for each group;

a step of storing a value obtained by summing in said summing step as the amount $\Delta T_i(n)$ indicative of the heat amount stored in the sectioned i-th portion for each group of said ink jet head;

a step of summing all the amounts $\Delta T_i(n)$ to determine an amount $\Delta T$ corresponding to the heat amount stored in each group of said ink jet head; and a step of controlling the groups of said ink jet head in accordance with the amount $\Delta T$.

27. An ink jet method according to claim 26 wherein said control step changes a drive condition of said ink jet head in accordance with the amount $\Delta T$ at said predetermined time interval.

28. An ink jet method according to claim 27 further comprising means for detecting an ambient temperature of said ink jet head;

wherein said control means changes the drive condition of said ink jet head in accordance with the ambient temperature.

29. An ink jet method according to claim 26 further comprising:

a step of measuring a number of times of discharge of said ink jet head in said predetermined time interval for each group; and a step of converting the number of times of discharge to the amount $\Delta Q_i$.

30. An ink jet method according to claim 27 further comprising:

a step of measuring a number of times of discharge of said ink jet head in said predetermined time interval for each group; and a step of for converting the number of times of discharge to the amount $\Delta Q_i$.

31. An ink jet method according to claim 30 wherein said measurement step corrects the number of times of discharge of each group of said ink jet head in said predetermined time interval $\Delta t$ by the drive condition of each group of said ink jet head.

32. An ink jet method according to claim 30 wherein each said heat generating element has a characteristic and said measurement step corrects the number of times of discharge of each group of said ink jet head in said predetermined time interval $\Delta t$ by a characteristic of said heat generating element of each group of said ink jet head.

33. A temperature calculation apparatus for detecting a temperature of an object varying with an energy applied thereto, the object having a plurality of thermal time constants, comprising:

deriving means for deriving an amount $\Delta Q_i$ indicative of a heat amount stored in a predetermined time interval $\Delta t$ in $i(i \geqq 1)$ portions of said object sectioned according to types of the thermal time constants, accompanied by the heat generated by the driving of said ink jet head;

multiplying means for multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant, wherein $n \geqq 1$;

adding means for adding the amount $\Delta Q_i$ to a value obtained by multiplication by means of said multiplying means;

storing means for storing a value obtained by addition by means of said adding means as the amount $\Delta T_i(n)$ indicative of the heat amount stored in the sectioned i-th portion; and summing means for summing all the amounts $\Delta T_i(n)$ to determine an amount $\Delta T$ corresponding to the heat amount stored in said object.

34. A temperature calculation method for detecting a temperature of an object varying with an energy applied thereto, the object having a plurality of thermal time constants, comprising:

a step of deriving an amount $\Delta Q_i$ indicative of a heat amount stored in a predetermined time interval $\Delta t$ in $i(i \geqq 1)$ portions of said object sectioned according to types of the thermal time constants, accompanied by the heat generated by the driving of said ink jet head;

a step of multiplying an amount $\Delta T_i(n-1)$ indicative of the heat amount stored in the sectioned i-th portion of the predetermined time interval $\Delta t$ earlier by a predetermined constant $E_i$ corresponding to the sectioned i-th thermal time constant, wherein $n \geqq 1$;

a step of adding amount $\Delta Q_i$ to a value obtained by multiplication in said multiplying step;

a step of storing a value obtained by addition in said adding step as the amount $\Delta T_i(n)$ indicative of the heat amount stored in the sectioned i-th portion; and a step of the summing all the amounts $\Delta T_i(n)$ to determine an amount $\Delta T$ corresponding to the heat amount stored in said object.

* * * * *

UNITED STATES PATENT AND TRADEMARK OFFICE

CERTIFICATE OF CORRECTION

PATENT NO. : 5,877,785

DATED : March 2, 1999

INVENTOR(S) : OSAMU IWASAKI, ET AL

It is certified that error appears in the above-identified patent and that said Letters Patent is hereby corrected as shown below:

COLUMN 1

Line 31, "to" should read --on--.

COLUMN 3

Line 56, "for" should be deleted.

COLUMN 4

Line 5, "sows" should read --shows--; and
Line 40, "elapse" should read --lapse--.

COLUMN 9

Line 32, "required this" should read --required. This--.

UNITED STATES PATENT AND TRADEMARK OFFICE

CERTIFICATE OF CORRECTION

PATENT NO. : 5,877,785

DATED : March 2, 1999

INVENTOR(S) : OSAMU IWASAKI, ET AL

It is certified that error appears in the above-identified patent and that said Letters Patent is hereby corrected as shown below:

COLUMN 14

Line 8, "group," should read --group;--.

Signed and Sealed this

Seventh Day of December, 1999

*Attest:*

Q. TODD DICKINSON

*Attesting Officer*

*Acting Commissioner of Patents and Trademarks*